US005107937A

United States Patent [19]

Yeargin et al.

[11] Patent Number: 5,107,937

[45] Date of Patent: Apr. 28, 1992

[54] AUTOMATED ROCK BURNER

[76] Inventors: Clarence M. Yeargin, Rte. 1, Box 209; Charles R. Guest, Rte. 2, Box 83, both of Elberton, Ga. 30635

[21] Appl. No.: 716,407

[22] Filed: Jun. 17, 1991

[51] Int. Cl.[5] ..... E21B 7/14; E21B 19/08; E21B 44/00; E21C 37/16

[52] U.S. Cl. ..... 175/27; 175/14; 431/158

[58] Field of Search ..... 175/11-17, 175/27, 122, 162, 203; 173/4; 431/158

[56] References Cited

U.S. PATENT DOCUMENTS

| | | | |
|---|---|---|---|
| 2,679,381 | 5/1954 | Royer et al. | 175/27 X |
| 2,935,303 | 5/1960 | Royer et al. | 175/14 |
| 3,207,238 | 9/1965 | Davidson et al. | 175/27 X |
| 3,658,453 | 4/1972 | Vasselin | 175/14 X |
| 3,870,111 | 3/1975 | Tuomela et al. | 175/11 |
| 4,319,647 | 3/1982 | Browning | 175/14 |

*Primary Examiner*—Stephen J. Novosad
*Attorney, Agent, or Firm*—Cort Flint

[57] ABSTRACT

An automated burner for channelling a mineral body, including, a guide shaft assembly having a guide shaft adapted to receive a burner staff for reciprocal movement. A first drive means is connected to the burner staff and is operative to reciprocally move the staff through a positive stroke in one direction and a gravity urged stroke in the opposite direction. A first control means is associated with the first drive means to reverse the direction of the reciprocal movement upon completion of positive stroke, upon completion of a gravity urged stroke and upon premature cessation of a gravity urged stroke. A second drive means connected to the guide shaft to impart oscillating motion thereto. So that the burner head is moved with a simultaneous reciprocating and oscillating movement through controlled cycles.

23 Claims, 6 Drawing Sheets

AUTOMATED ROCK BURNER

BACKGROUND OF THE INVENTION

This invention relates to an automated burner device for channelling a mineral body, usually granite or marble.

The use of hand operated mineral burning devices is a well known process for cutting channels in a mineral body so that blocks of the mineral may ultimately be removed. The process is slow and costly but to date it is the most efficient manner of preparing the blocks for removal.

A major disadvantage of channelling in this manner is the extreme noise generated by the burner to which the operator is exposed. The noise level can reach .126 decibels, which over a period of time can result in severe health problems. Because of this danger to the operator, the U.S. Bureau of Mines has mandated that the noise level at which an operator may be exposed be no more than .95 decibels or that the operator be at least 15 feet from the burner when in operation.

As no satisfactory alternative channeling device is currently available, this requirement fostered attempts to produce a burner device which can operate independently of an operator, i.e. an automated burner.

The prior art does not indicate that an automated burner has yet been assembled. Known disclosures such as U.S. Pat. Nos. 4,319,647 and 3,658,453 are directed to improved burner head structures which are intended to be manually operated. U.S. Pat. No. 2,935,303 is directed to an automatic control which acts only to reciprocate a burner so as to form vertical holes. There is no disclosure for channel forming.

There is at least one automated burner which is not documented, but which is known to be in operation. This device consists of a series of pneumatic cylinders which act to control an end portion of a burner staff to simulate the reciprocal and oscillating motion of an operator. The device has not proven to be satisfactory due to high maintenance which results in an inordinate amount of down time.

It is an object of the present invention to provide an automated burner which overcomes the problems indicated above.

Another object of the invention is to provide an automated burner which is mechanically motivated so as to be easily maintained.

Another object of the invention is to provide an automated burner which is easily transportable.

SUMMARY OF THE INVENTION

An automated burner for channeling a mineral body including, carrying rails supporting a burner carriage for movement along a longitudinal path. The burner carriage including a guide shaft which is adapted to carry a burner staff for reciprocating motion. A burner head is carried at one end of the burner staff. A guide shaft is carried by a support shaft having spaced bearing means which mount the guide shaft for oscillating motion. Connecting means connect the support shaft with the burner carriage member.

A first drive means provides reciprocal motion for the burner staff and a first control means controls the reciprocal motion in each direction through a selected cycle stroke. A second drive means provides oscillating motion for the guide means. There are second control means which adjustably control the angle of oscillation and the length of oscillation of the guide means. Finally, there are third control means which include means incrementally moving the burner carriage in the longitudinal direction in response to a complete cycle of reciprocal movement of the burner staff so that the carriage is moved a prescribed distance along the longitudinal path upon completion of each cycle stroke so that the channeling proceeds uninterrupted. The carrying rails are secured to a housing member which includes track mounted wheels and a drive motor. The third control means actuate the drive motor to which incrementally moves the housing member. There are four of the wheels.

In this arrangement the burner carriage is carried for manual longitudinally adjusted positions along the carrying rails. In one arrangement, means are provided which mount the carrying rails in vertical spaced relation to the mineral body. The burner carriage is moved along the carrying rails by drive means including a rack secured to the carrying rails and a drive motor carried by the burner carriage. The motor has a pinion interacting with the rack. The third control means actuates the drive motor to incrementally move the burner carriage. The means mounting the carrying rails include vertical rods longitudinally spaced along the carrying rails. The rods are provided with retractable feet members which act to maintain the rods in a vertical position.

The guide shaft is circular and is provided with guide rollers arranged about its periphery at spaced locations. The rollers engage planar surfaces of the burner staff and provide the path way for its reciprocal motion. The first drive means includes a first drive motor mounted to the guide shaft. Means are provided to connect the first drive motor with a first end of the burner staff. The connecting means act to convert rotary motion of the first drive motor into reciprocal motion for the burner staff. This reciprocal motion is positive in an upward direction and gravity driven in a downward direction. The connecting means, which includes a cable act to positively control the maximum rate of motion in each direction.

The first control means acts to drive the first drive motor two directions. The first control means includes a sensor which senses the movement of the burner staff in its downward direction. Upon cessation of this movement prior to a completed downward stroke, the sensor acts to reserve the direction of the motor to begin an upward stroke. The connecting means includes a cable which is held taught during motion of the burner staff through complete reciprocal motion cycles, but becomes slack upon premature interruption of the reciprocal cycle. The sensor acts to sense taughtness.

The burner staff includes a plurality of planar sides creating a hollow interior, a water line is connected to the hollow interior while a fuel line and an air line extend through the hollow interior. These latter two lines are connected at one end to the burner head and at an opposite end to supply means. Baffle means are provided to seal the opposed ends of the hollow interior whereby water from the water line may fill the hollow interior and act as a coolant.

A water spray nozzle is connected with the hollow interior adjacent the burner head whereby water may be sprayed on channel forming walls to settle dust created by the burner and to cool the channel walls. The second drive means include motor mounted to the support shaft. Linkage means connect the motor with the guide shaft and convert rotary motion of the motor to oscillating motion for the guide shaft. The linkage means includes a first rotary disk driven by the motor and a radially extending flange secured to the guide shaft. A lever is mounted in radially adjustable mountings on the disk and circumferentially adjusted mountings on the disk so that reciprocating motion is imparted to the guide shaft which is adjustable both as to its angle of arc and the distance of arc.

The means connecting the support shaft with the carriage member includes an axle secured to the support shaft. A bearing formed in the carriage receives the axle to form an axis of rotation for the support shaft, guide shaft, and burner staff. This arrangement allows for the burner staff to be positioned at selected circumferential positions about the axis to accommodate angular burning and movement between burnings. Locking means are provided adjacent the axis of rotation which function to fixedly lock the support shaft, guide shaft and burner staff in desired positions about the axis.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
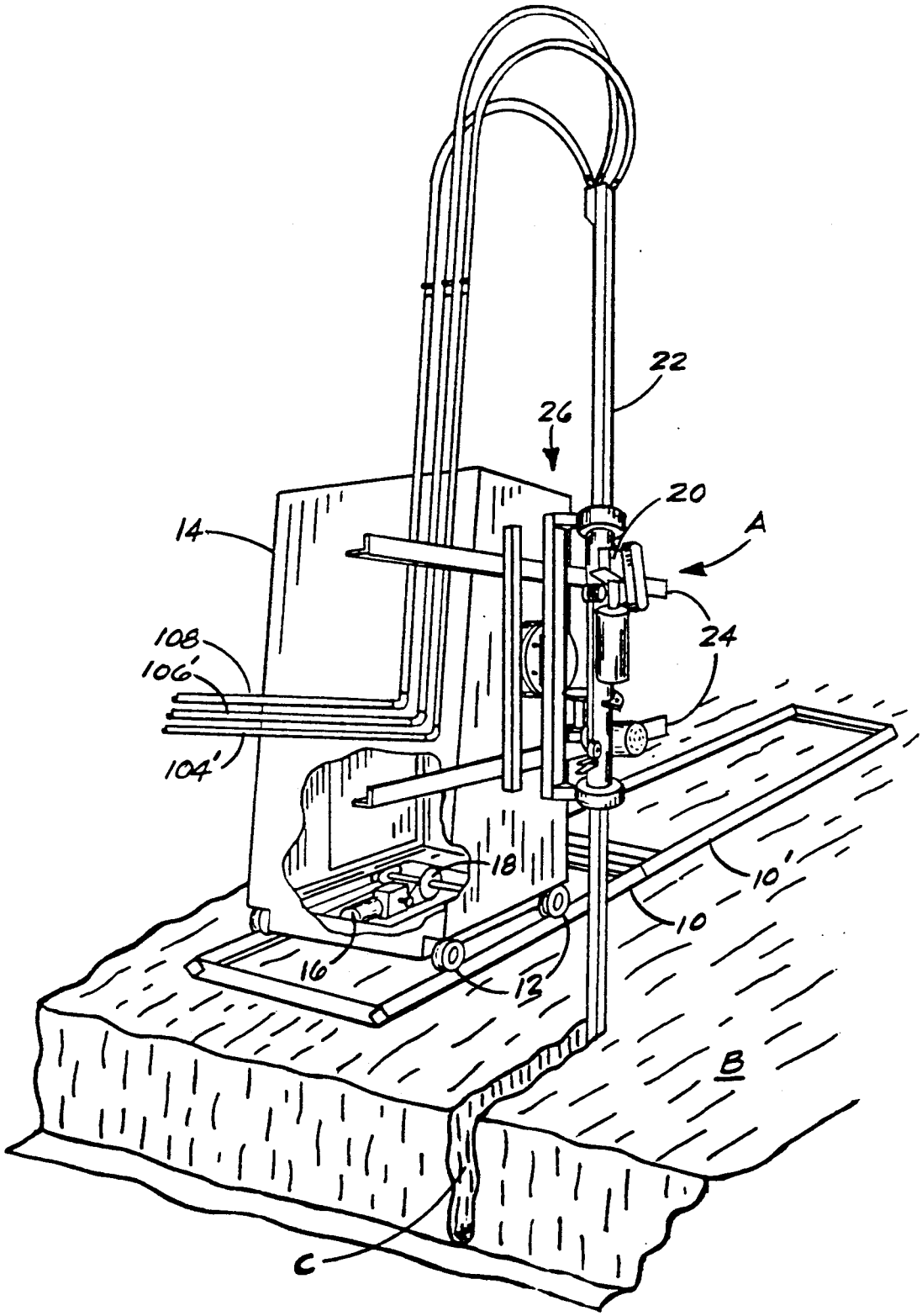
FIG. 1 is a perspective view of one embodiment of an automated burner assembly.

A first embodiment of an automated burner is shown at A in FIG. 1. Burner A is supported on track 10, 10' which rest on the upper surface of the mineral B in which a channel C is being burned. Burner A includes housing 14 which is carried by four wheels 12 which run on track 10, 10'. The track consists of two sections 10, 10' which are assembled in leap frog fashion so as to always accommodate the burner as it moves across the mineral surface.

Housing 14 includes an electric motor, gear housing drive assembly 16 which is operated to drive one pair of wheels 12 in a step by step fashion via a sprocket and chain assembly 18. Motor assembly 18 is activated by a signal from control 20 to move housing 14 forward approximately two inches upon the completion of a burn stroke of burner staff 22. This operation will be described in more detail at a later time.

Figure 5:
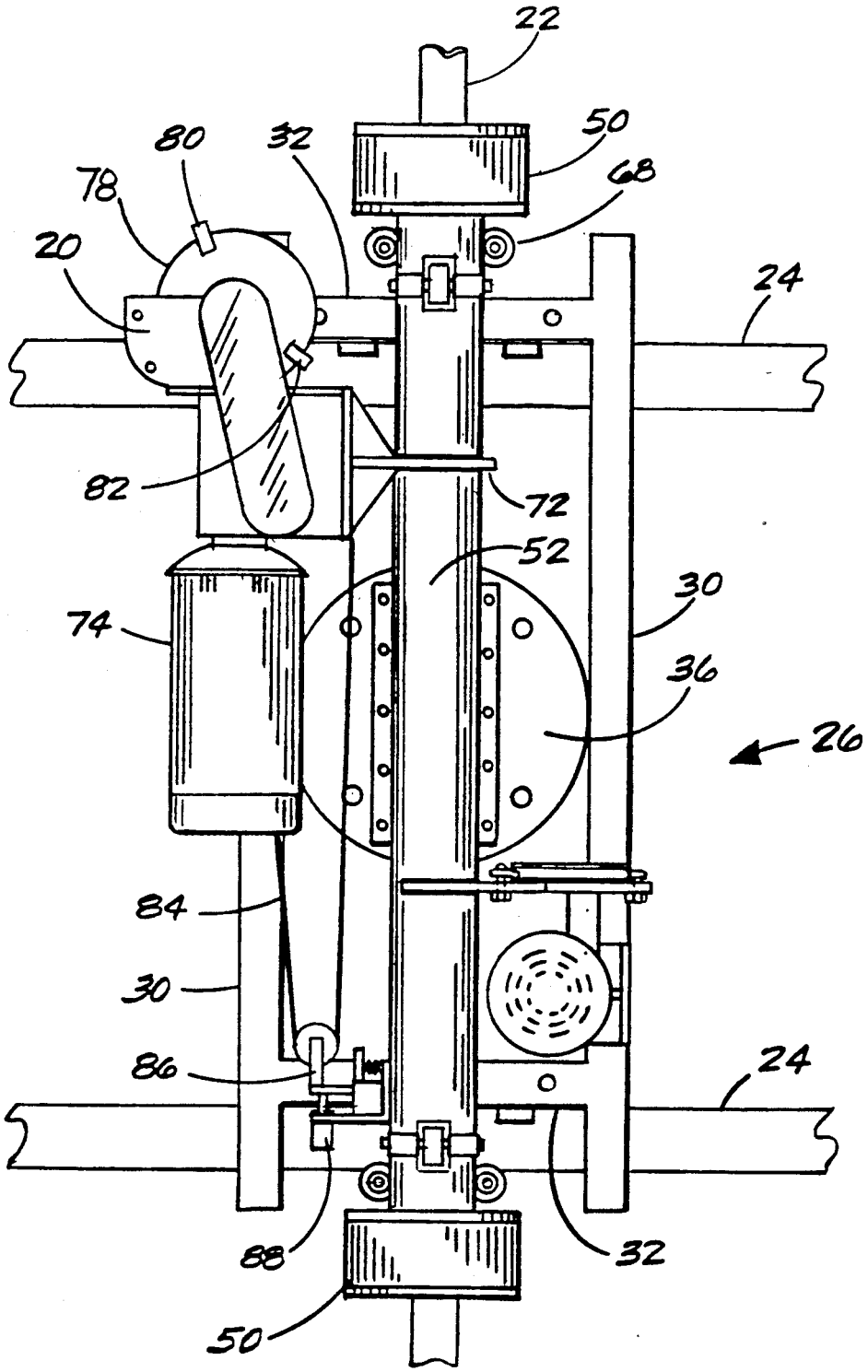
FIG. 5 is a sectional side view of the carriage arrangement of FIG. 1.
Figure 6:
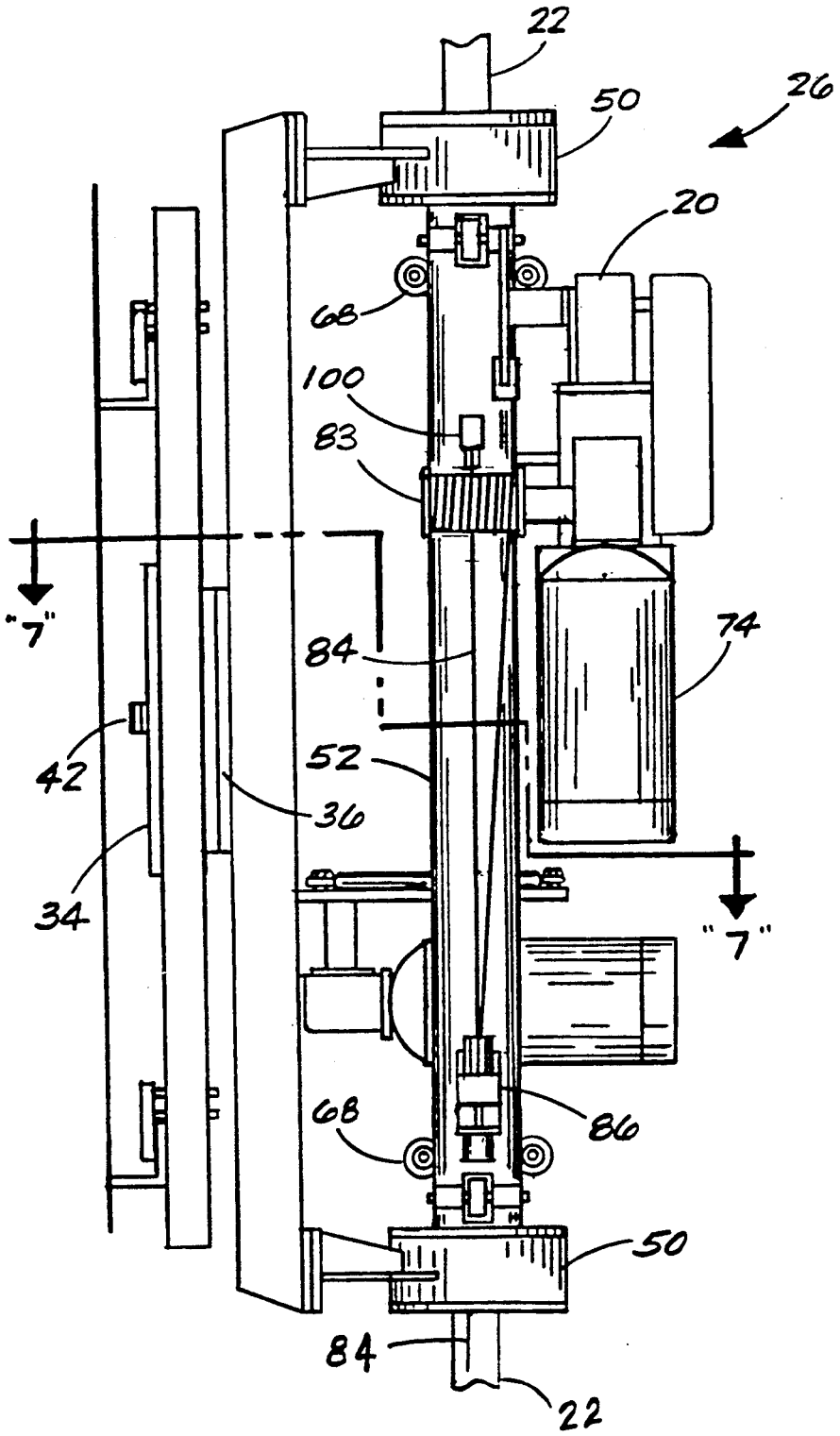
FIG. 6 is a sectional end view of the carriage arrangement of FIG. 1.

Housing 14 has a pair of vertically spaced horizontal rails mounted to one side thereof. A burner carriage 26, best seen in FIGS. 5 and 6 is mounted on rails 24. Carriage 26 includes a pair of vertical rods 30 interconnected via spaced horizontal rods 32. Vertical rods 30 have mounting means shown at 28 which secure the carriage to rails 24 but are operative to allow longitudinal adjustment of carriage 26 along the rails. This longitudinal adjustment enables carriage 26 to be placed at either end of rails 24 so that it may operate adjacent to vertical walls, if necessary.

Carriage 26 includes a vertical support shaft 40 which has a disk 36 secured to its rear side intermediate its ends. Disk 36 has an axle 42 extending perpendicularly away from shaft 40. A mating disk 34 is secured intermediate vertical rods 30, preferably by welding, and is provided with bore 44. Axle 42 is adapted to be received in bore 44 to support burner staff 22 for pivotal movement. A circular channel 46 is provided in disk 34 to receive the head of securing bolts 48. Bolts 48 pass through bores in disk 36 and are arranged to secure disk 34, 36 together when tightened. When bolts 48 are loosened, channel 46 allows the heads thereof to move about bore 44 as disk 36 is rotated to adjust the position of staff 22 anywhere between vertical and horizontal. When the desired position is obtained, bolts 48 are tightened and the alignment of staff 22 is maintained.

Support shaft 40 carries at its opposite ends bearing members 50. A guide shaft 52 is mounted at its opposite ends in bearing members 50 and arranged for rotational motion. Intermediate the length of guide shaft 52 there is secured a flange 54 which is provided with a plurality of bores 56. Secured to support rod 40 by a bracket assembly 66 is a motor gear housing drive assembly 64. Assembly 64 drives a disk 60 at a prescribed rate. A connecting rod 58 is connected at one end to disk 6 and at its opposite end to 54. Rotation of disk 60 drives guide 52 through a reciprocating motion. The length of the reciprocating stroke is adjustable by selecting between bores 62 in disk 60 for attachment of arm 58. The bores are arranged different distances from the axis of rotation. To adjust the angle of oscillation, the opposite end of arm 58 is moved between bores 56 in flange 54.

Guide shaft 52 is provided at its opposite ends with guide rollers or bearings 68. The bearings are adjustably secured to shaft 52 by suitable means 70 and are arranged to extend through slits in the side of the guide shaft. Bearings 68 act to guide burner staff 22 through its reciprocal movement within guide shaft 52. Alignment of burner staff 22 within guide shaft 52 is maintained by adjusting the relative positions of rollers or bearings 68.

Figures 8, 9:
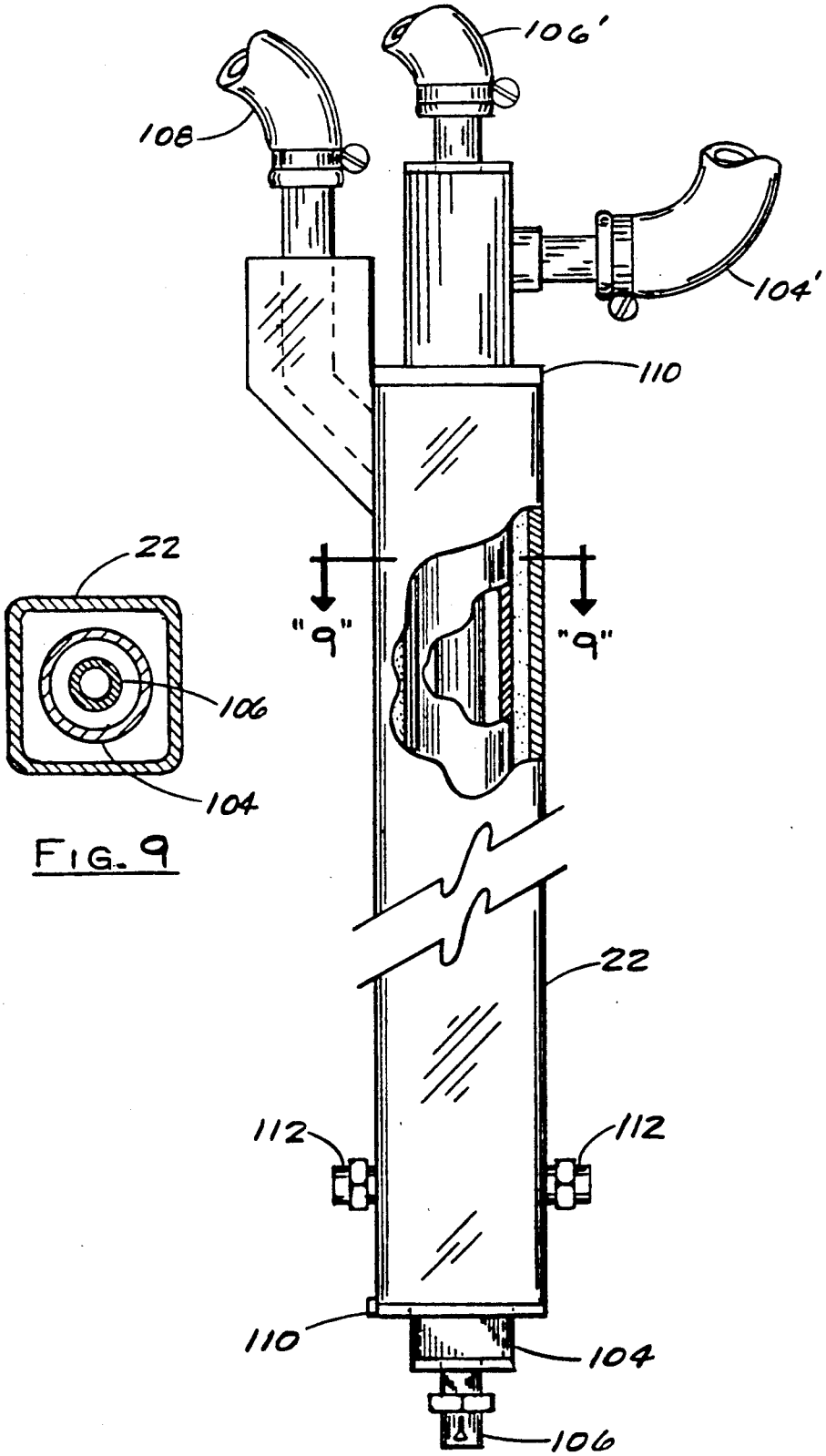
FIG. 8 is a sectional side view of the burner staff.
FIG. 9 is a sectional top view taken along line 9—9 of FIG. 8.

Burner staff 22 preferably consists of an elongated hollow member having four planar side surfaces of equal configurations as shown in FIGS. 8 and 9. Any member of side surfaces could be accommodated. Burner staff 22 is arranged to extend through guide shaft 52 and to project from each end thereof.

Secured to guide shaft 52 at 72 is a second elect ric motor gear housing drive assembly 74 which is operative to drive reel 82 in opposite directions. Drive assembly 74 includes a control means 20 which is operative on signal to reverse the direction of rotation of the motor of the drive assembly. Control means 20 consist of a disk 78 having adjustably positioned dogs 80, 82 secured to its periphery. Rotation of disk 78 a selected distance causes dog 80 to actuate a reversing switch of control 20 whereupon the motor of assembly 74 is driven in the opposite direction. Again, when the selected distance has been reached, dog 82 actuates the reverse switch and the direction of movement is again reversed.

Figure 7:
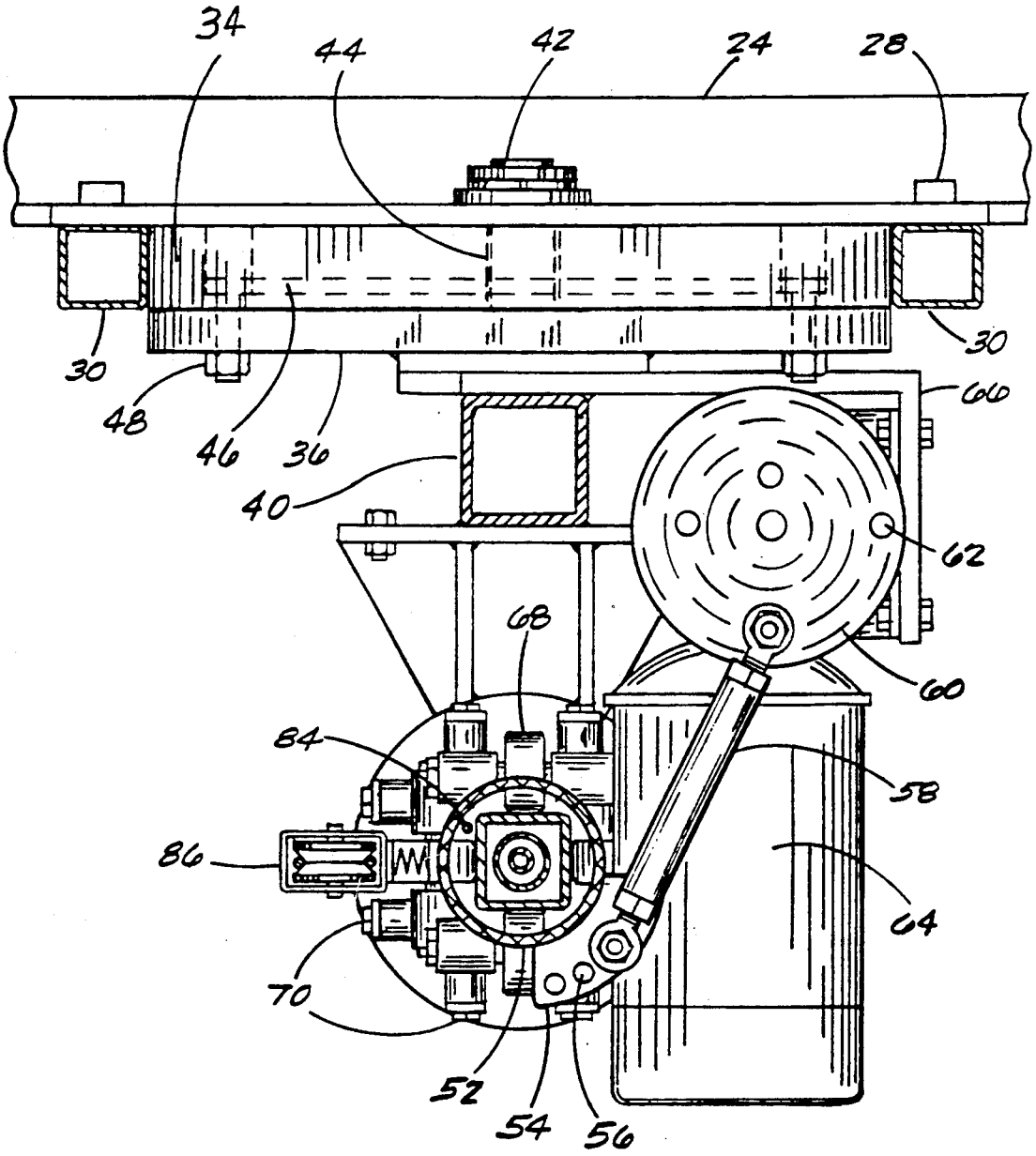
FIG. 7 is a top sectional view taken along line 7—7 of FIG. 6.

Cable 84 is attached to reel 83 and extends downward about control arrangement 86 and then upwardly and over pulley 100, see FIGS. 5 and 6. Pulley 100 extends through a slot in the side wall of guide shaft 52 so as to guide cable 84 into the interior thereof as shown in FIG. 7. The cable then extends down guide shaft 52 and is connected to the burner staff 22 adjacent its end at 110, see FIG. 8.

Control 86 consists of a pulley, guiding cable 84, which is biased toward switch 88 by suitable means such as a spring or gravity mount. Switch 88 is connected to control 20 to reverse the direction of rotation of the motor of drive assembly 74 when activated.

Burner staff 22, seen in FIGS. 8 and 9 includes a fuel pipe 106 and an air pipe 104 which extend through and beyond the hollow interior of the staff. Pipes 104, 106 are connected to suitable supply sources by means of tubes 104', 106'. Baffles or water tight seals 110 are arranged at upper and lower end of staff 22. Water, supplied from source 108, is fed into the interior of staff 22 to surround pipes 104, 106 and act as a coolant. Spray members 112 are arranged at the lower end of staff 22 which allow water to cool the just formed channel walls by spraying. The spraying of water also acts to settle dust created by the burning action.

Any suitable burner head, such as in U.S. Pat. No. 3,658,453, is attached to the ends of pipes 104, 106.

In operation, the device operates in the following manner. Housing 14 is arranged on tracks 10, 10' in position parallel with the longitudinal axis of the channel to be cut or burned. The vertical angle of shaft 52 is set by the relative positioning of disc 34 and 36. The length of the vertical stroke is set by the position of dogs 80, 82 on the periphery of disk 78. The oscillation stroke and angle is set through means 54, 58, 60. The burner head is fired and the motors of drive assemblies 64, 74 are activated. Drive assembly 64 drives guide tube 52 through continuous oscillating motion. Drive assembly 74 drives reel 83 in reversing directions. First reel 82 is driven in a direction to take up cable 84 which positively elevates burner staff 22. Upon reaching a selected elevation, dog 82 activates control 20 to reverse the direction of the motor of drive assembly 74. Gravity allows staff 22 to descend while drive assembly 74 through cable 84, and reel 83 controls the rate of descent. Upon reaching a selected level of descent, dog 80 actuates control 20 which again reverses the direction of motor drive 74. Dog 80 also actuates control 20 to actuate drive assembly 16 to move housing 14 through a selected increment of movement. Should staff 22 during its descending motion become obstructed so that its descent is stopped, cable 84 becomes slack. This allows arrangement 86 to actuate switch 88 to cause control 20 to reverse the direction of the motor drive arrangement 74. Burner staff 22 is subsequently again drawn to its elevated position to where it begins again its descending motion. Because a complete descending stroke was not made, dog 80 does not actuate control 20 and consequently drive assembly 16 is not actuated.

Figures 2, 3, 4:
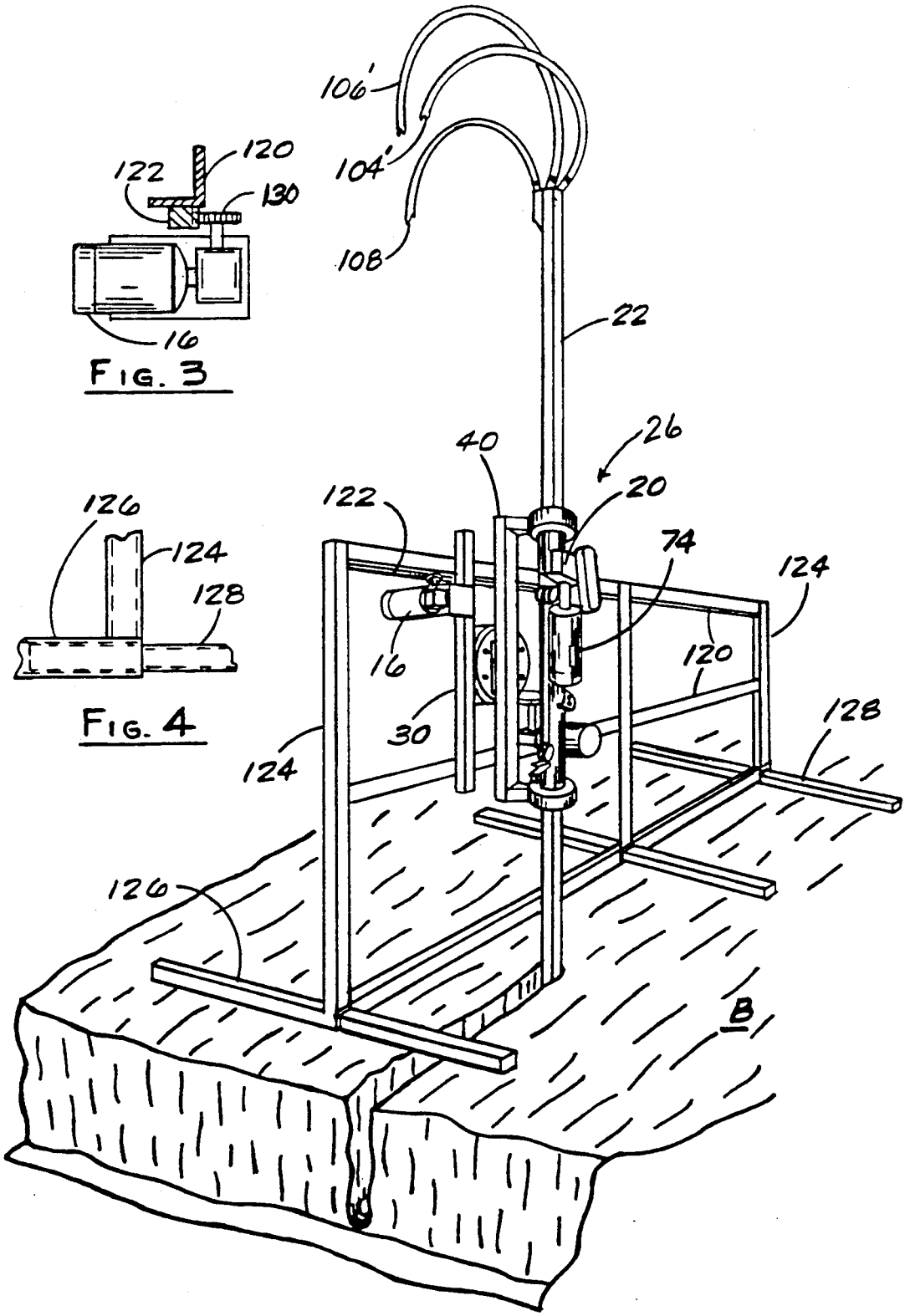
FIG. 2 is a perspective view of an alternate embodiment of an automated burner assembly.
FIG. 3 is an exploded end view of the longitudinal drive for the embodiment of FIG. 2.
FIG. 4 is an exploded end view of the foot structure for the embodiment of FIG. 2.

An alternative embodiment is shown in FIGS. 2, 3, and 4. Carriage 26 is as previously described with the exception that drive assembly 16 is attached to one of the vertical rods 30. Carriage 26 is mounted for longitudinal movement on rails 120 by suitable means. A rack 122 is arranged beneath the upper rail 120 and pinion 130 is connected to be driven by drive assembly 16.

Rails 120 are supported in vertically spaced horizontal positions by posts 124. The posts are held in an upright vertical position by feet 126, 128. Foot 128 is arranged to be telescoped into foot 126 in order to allow burner staff 22 to move past a post 124. The arrangement operates in the manner of the previously described species with the exception that carriage 26 is moved along rails 120 which are stationary.

While a preferred embodiment of the invention has been described using specific terms, such description is for illustrative purposes only, and it is to be understood that changes and variations may be made without departing from the spirit or scope of the following claims.

What is claimed is:

1. An automated burner for channeling a mineral body, said burner including:

carrying rails supporting a burner carriage for movement along a longitudinal path;

said burner carriage including a guide shaft which is adapted to carry a burner staff, which includes a burner head, for reciprocating motion;

a support shaft having spaced bearing means which mount said guide shaft for oscillating motion;

means connecting said support shaft with said burner carriage member;

first drive means providing reciprocal motion for said burner staff;

first control means controlling said reciprocal motion in each direction through a selected cycle stroke;

second drive means providing oscillating motion for said guide means;

second control means adjustably controlling the angle of oscillation and the length of oscillation of said guide means; and third drive means including means incrementally moving said burner carriage in said longitudinal direction in response to a complete cycle of reciprocal movement of said burner staff;

whereby said carriage is moved a prescribed distance along said longitudinal path upon completion of each cycle stroke so that said channeling proceeds uninterrupted.

2. A burner according to claim 1 wherein said carrying rails are secured to a housing member which includes track mounted wheels and a drive motor, said third control means actuating said drive motor to incrementally move said housing member.

3. A housing according to claim 2 wherein there are four of said wheels.

4. A burner according to claim 2 wherein means carry said burner carriage for manual longitudinally adjusted positions along said carrying rails.

5. A burner according to claim 1 wherein means are provided which mount said carrying rails in vertical spaced relation to said mineral body;

drive means including a rack are secured to one of said carrying rails and a drive motor carried by said burner carriage, said motor having a pinion interacting with said rack;

said third control means actuating said drive motor to incrementally move said burner carriage.

6. Burner according to claim 5 wherein said means mounting said carrying rails include vertical rods longitudinally spaced along said carrying rails, retractable feet members are provided to maintain said rods in said vertical position.

7. Burner according to claim 1 wherein said guide shaft is circular, means mounting guide rollers about the periphery of said guide shaft at spaced locations to engage planar surfaces of said burner staff to provide a path way for said reciprocal motion thereof.

8. Burner according to claim 1 wherein said first drive means includes a first drive motor mounted to said guide shaft, means connecting said first drive motor with a first end of said burner staff, said connecting means converting rotary motion of said first drive motor to reciprocal motion for said burner staff.

9. Burner according to claim 8 wherein said reciprocal motion is positive in an upward direction and gravity driven in a downward direction, said connecting means acting to positively control the maximum rate of motion in each direction.

10. Burner according to claim 9 wherein said connecting means includes a cable.

11. A burner according to claim 8 wherein said first control means act to drive said first drive motor in two directions.

12. A burner according to claim 1 wherein said burner staff includes a plurality of planar sides creating a hollow interior, a water line is connected to said hollow interior, a fuel line and an air line extend through said hollow interior and are connected at one end to said burner head and at an opposite end to supply means, baffle means are provided to seal said opposed ends of said hollow interior whereby water from said water line may fill said hollow interior and act as a coolant.

13. Burner according to claim 12 where a water spray nozzle is connected with said hollow interior adjacent said burner head whereby water may be sprayed onto channel forming walls to settle dust created by said burner and to cool said channel walls.

14. Burner according to claim 1 wherein said second drive means include an electric motor mounted to said support shaft, linkage means connecting said motor with said guide shaft and converting rotary motion of said motor to oscillating motion for said guide shaft.

15. Burner according to claim 14 wherein said linkage means includes a first rotary disk driven by said motor, a radially extending flange secured to said guide shaft, a lever mounted in radially adjustable mountings on said flange and circumferentially adjusted mountings on said disk whereby the reciprocating motion imparted to said guide shaft is adjustable both as to its angle of arc and its distance of arc.

16. Burner according to claim 1 wherein said means connecting said support shaft with said carriage member includes an axle secured to said support shaft and a bearing formed in said carriage which receives said axle to form an axis of rotation for said support shaft, guide shaft and burner staff, whereby said burner staff may be positioned at selected circumferential positions about said axis to accommodate angular burning and burning movement.

17. Burner as set forth in claim 16 wherein locking means are provided adjacent said axis of rotation which function to lock said support shaft, guide shaft and burner staff in desired positions about said axis.

18. Burner according to claim 9 wherein said first control means includes means which is controlled by the movement of said burner staff in its downward directions of movement so that cessation of said downward movement prior to the completion of said cycle stroke, said means acts to reserve the direction of said motor to begin an upward stroke.

19. Burner according to claim 18 wherein said connecting means includes a cable which is held taught during movement of said burner staff through a complete cycle stroke, but becomes slack upon premature interruption of said cycle stroke; and said means is arranged to sense said taughtness.

20. An automated burner for channelling a mineral body, said burner including:

a guide shaft assembly including a guide shaft adapted to receive a burner staff for reciprocal movement;

first drive means connected to said burner staff and operative to reciprocally move said staff through a positive stroke in one direction and a gravity urged stroke in an opposite direction;

first control means associated with said first drive means, said first control means acting to reverse the direction of said reciprocal movement upon completion of said positive stroke, upon completion of said gravity urged stroke and upon premature cessation of said gravity urged stroke, second drive means connected to said guide shaft to impart oscillating motion thereto; whereby said burner head is moved through said controlled cycles with a simultaneous reciprocating and oscillating movement.

21. A burner according to claim 20 wherein means mount said guide staff for controlled longitudinal movement along said mineral body.

22. A burner according to claim 21 wherein said mounting means includes a housing having a plurality of wheels mounted on a track extending parallel said channel;

third drive means are connected with said wheels and controlled to drive said wheels in response to movement of said burner head through a completed cycle.

23. A burner according to claim 21 wherein said mounting means includes a pivotal mounting and a locking mechanism associated with said guide shaft assembly; whereby said guide shaft may be secured in adjusted positions about said pivotal mounting between vertical and horizontal.

* * * * *